United States Patent [19]

van Hest

[11] Patent Number: 4,534,387

[45] Date of Patent: Aug. 13, 1985

[54] METHOD AND APPARATUS FOR INSERTING DIFFERENT WEFT THREADS HAVING DIFFERENT PROPERTIES INTO THE WARP SHED OF A JET WEAVING MACHINE

[75] Inventor: Cornelius A. J. H. van Hest, Helmond, Netherlands

[73] Assignee: Ruti-te Strake B.V., Netherlands

[21] Appl. No.: 408,808

[22] Filed: Aug. 17, 1982

[30] Foreign Application Priority Data

Jan. 18, 1982 [NL] Netherlands ..... 8200169

[51] Int. Cl.³ ..... D03D 47/30

[52] U.S. Cl. ..... 139/435

[58] Field of Search ..... 139/435, 452; 226/97

[56] References Cited

U.S. PATENT DOCUMENTS

| | | | |
|---|---|---|---|
| 4,020,877 | 5/1977 | Spisiak et al. | 139/435 |
| 4,143,682 | 3/1979 | Jansa et al. | 139/435 |
| 4,290,460 | 9/1981 | Deborde | 139/435 |
| 4,332,280 | 6/1982 | Manders | 139/435 |
| 4,372,349 | 2/1983 | Mullekom | 139/435 |
| 4,458,726 | 7/1984 | Wenig | 139/435 |

*Primary Examiner*—Henry S. Jaudon

*Attorney, Agent, or Firm*—Burns, Doane, Swecker & Mathis

[57] ABSTRACT

Different weft threads are drawn off of different supply spools and are inserted through a first and a second jet arrangement in accordance with a predetermined insertion sequence. In the process, the fluid supply pressure for at least a portion of the second jet arrangement is selected at different values for the different types of weft thread. This pressure is changed synchronously with the weft insertion sequence. In this way, different weft thread types may be inserted in combinations not heretofore possible without leading to problems, e.g., operating problems or weaving faults. These problems are avoided since the weft threads of each type are transported optimally and gently, and are held taut without damaging the threads.

13 Claims, 2 Drawing Figures

METHOD AND APPARATUS FOR INSERTING DIFFERENT WEFT THREADS HAVING DIFFERENT PROPERTIES INTO THE WARP SHED OF A JET WEAVING MACHINE

BACKGROUND AND SUMMARY OF THE PRESENT INVENTION

The present invention relates generally to improvements in weaving and weaving machines. More particularly, the present invention relates to a method of inserting different weft threads having different yarn properties into the warp shed of an air jet weaving machine according to a predetermined insertion pattern or sequence. The different weft threads are fed from corresponding spools to a first jet arrangement supplied with a flowing fluid. The weft threads are inserted into the warp shed through the first jet arrangement and a second jet arrangement downstream of the first jet arrangement in the weft insertion direction. The second jet arrangement is also supplied with a flowing fluid.

In the previous insertion methods which are widely known and used on numerous commercially available air jet weaving machines, different types of weft threads are generally not transported in the identical manner by the flowing fluid. The differences in the weft threads may be differences in such characteristics as the material, the thickness, the color, or the surface properties. Differences in thread properties can affect, e.g., the energy transfer of the flowing fluid to the weft thread. For example, fuzzy threads provide better energy transfer than smooth threads. In order to ensure that the less easily transported threads are inserted within the time period available for weft insertion (according to the known methods), the fluid is supplied to the first jet arrangement at a higher pressure for these weft threads than for more easily transported weft threads. At the same time, the fluid supply pressure at the second jet arrangement is kept the same for all types of weft threads.

Since the fluid supply pressure at the first jet arrangement may be increased only within the limited range below the point at which the given thread is damaged, it has not been possible previously to employ certain combinations of widely differing yarns. Attempts to do so have led to weaving faults (due to a too low pressure used with a less easily transported weft thread) or to damage of the weft thread (due to a too high pressure). Also, the known technique of keeping the pressure at the second jet arrangement constant has been detrimental. When the pressure is too low, a less easily transported weft thread is inserted, and held after insertion, in a too slack condition. Further, when the pressure is too high, a weft thread which is sensitive to being damaged, e.g., a slightly twisted yarn, may suffer damage. With a slightly twisted yarn, unraveling of the leading end of the yarn by the action of the fluid may occur.

It is therefore an object of the present invention to improve the known insertion method such that different weft thread types may be inserted in combinations not heretofore possible, without leading to problems (i.e., operating problems) or to faults.

This object and others are achieved according to the present invention by the following technique. The fluid supply pressure for at least a portion of the second jet arrangement is changed for different types of weft thread, synchronously with the insertion sequence.

Nearly all types of weft threads may be combined and inserted without difficulties when the method according to the present invention is employed. The beneficial effects of the technique of the present invention extend beyond the direct effect of the second jet arrangement on the transporting and tensioning and/or holding taut of the weft thread. There is also an indirect effect on the first jet arrangement, in that the range of fluid supply pressures needed for proper adjustment of the first jet arrangement is less when the fluid supply pressure at the second jet arrangement is optimized in the present invention.

The present invention further relates to a jet weaving machine for inserting various types of weft threads having different yarn properties in a predetermined repeated insertion sequence. The machine comprises a first jet arrangement disposed upstream of the warp shed in the weft insertion direction and a second jet arrangement disposed downstream of the first (in the weft insertion direction) and connected to a source of pressurized fluid via a supply line. The supply line includes a controlled valve. Also, a weft preparation device is disposed upstream of the first jet arrangement in the weft insertion direction. Also, a control arrangement for controlling the feed sequence of the different weft threads from the weft preparation device to the first jet arrangement is provided.

The inventive jet weaving machine according to the present invention further includes a controlled adjusting means provided in connection with at least a portion of the second jet arrangement. In this way, the fluid supply pressure at the portion is adjustable to different values corresponding to different threads in the insertion sequence.

According to a further aspect of the present invention, the controlled adjusting means are connected to and controlled by the control arrangement which controls the feed sequence of the weft threads.

In a first embodiment of the inventive jet weaving machine, the fluid supply line for the second jet arrangement includes a first closing valve which is operated synchronously with the weft insertion cycle and sequence. The fluid supply line further includes a first pressure-reducing valve. At least one auxiliary supply line is included in the controlled adjusting means, which auxiliary line connects the source of the pressurized fluid to a segment of the main fluid supply line lying between the first reducing valve and the first closing valve. The auxiliary line includes a second closing valve and a second pressure-reducing valve. The second pressure reducing valve is set at a higher pressure than the first reducing valve, and the second closing valve is opened by the control arrangement which controls the feed sequence of the weft threads. The opening of the second closing valve occurs only during the insertion phase of the weft threads having yarn properties which require a higher fluid supply pressure.

In a second embodiment of the inventive jet weaving machine, the fluid supply line for the second jet arrangement includes a first closing valve and a first pressure-reducing valve. At least one second supply line connects the source of the pressurized fluid to the second jet arrangement, which second supply line includes a second closing valve and a second pressure-reducing valve. Both closing valves are connected to the control arrangement which controls the feed sequence of the weft threads and are selectively actuable corresponding to different threads in the insertion sequence.

BRIEF DESCRIPTION OF THE DRAWINGS

Preferred embodiments of the present invention will be described in greater detail with reference to the accompanying drawings wherein like members bear like reference numerals and wherein.

DETAILED DESCRIPTION OF THE PREFERRED EMBODIMENTS

Figure 1:
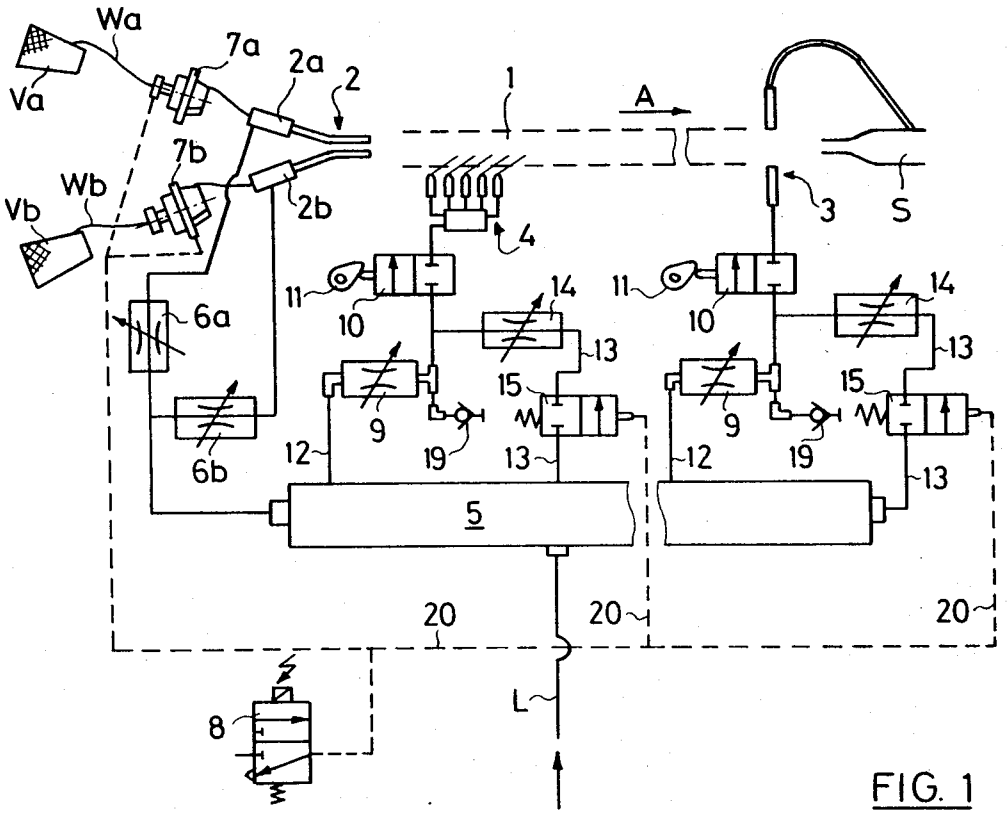
FIG. 1 is a schematic view of an air jet weaving machine according to a first embodiment of the present invention.
Figure 2:
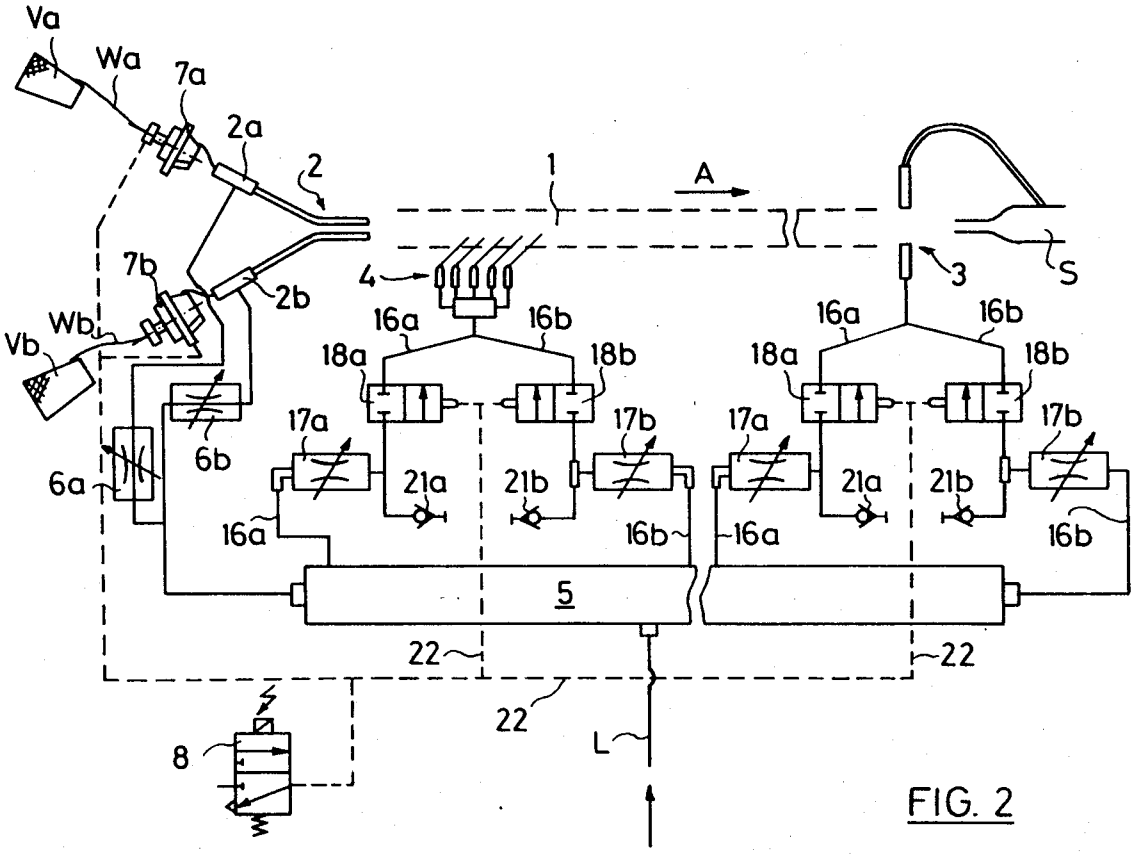
FIG. 2 is a schematic view of an air jet weaving machine according to a second embodiment of the present invention.

In both FIGS. 1 and 2, a warp shed 1 of an air jet weaving machine receives, during each weaving cycle, a weft thread inserted into the shed 1 in the direction of arrow A (i.e., from left to right in the drawings). The weft thread is then placed under tension, and thereafter is beaten-up by a reed (not shown). A first jet arrangement 2 is disposed at the left end of the shed 1, at which end the weft thread enters the shed. A tensioning jet 3 is disposed beyond the right end of the shed 1, at which end the weft thread exits from the shed. A vacuum nozzle S is disposed downstream of the tensioning jet 3 in the weft insertion direction A. The transport of the weft thread through the warp shed 1 is assisted by a plurality of auxiliary jets 4 which are disposed along the length of the shed 1 and may be moved into and out of the shed.

The jet arrangement 2, the tensioning jet 3, the vacuum nozzle S, and the auxiliary jets are known and will not be described further herein. These elements are generally of the type dislosed in U.S. Pat. Nos. 4,326,565, 4,096,889, and 3,705,608. Each of these elements is supplied with pressurized fluid, e.g., compressed air, via a fluid delivery system described further infra, from a reservoir 5 which is connected to a compressed air line L.

As shown in the drawings, the jet arrangement 2 is comprised of two jet nozzles 2*a*, 2*b* which are supplied with air from the reservoir 5 via two separately adjustable pressure-reducing valves 6*a*, 6*b*, respectively. Associated with each jet nozzle 2*a*, 2*b* is a weft preparation device 7*a*, 7*b* which draws off a different (in type or color) weft thread Wa, Wb, respectively from a corresponding yarn supply spool Va, Vb. The weft preparation device 7*a*, 7*b* stores the thread on a winding drum, and releases the required length of the thread at the proper time to the associated jet nozzle 2*a* or 2*b*. A weft preparation device of this general type is described in West German Offenlegungsschrift No. 30 32 971, corresponding to U.S. Pat. No. 4,372,349. The weft threads Wa, Wb are inserted in the warp shed 1 according to a definite sequence. For this purpose the weft preparation devices 7*a* and 7*b* are controlled by a control unit 8 such that the devices 7*a*, 7*b* release the respective stored weft thread Wa, Wb to the respective jet nozzle 2*a*, 2*b* in accordance with the timing of the definite sequence.

The control unit 8 in the drawings comprises a "3/2 valve" which is electromagnetically controlled. Alternatively, it is also possible control this "3/2 valve" by mechanical, pneumatic, or combined pneumatic and electrical means. The control of the valve is accomplished in a known manner, after the fashion of currently employed arrangements for controlling a color selector device, e.g., by a program recorded on punched cards or punched tape. In the drawings, all the control lines emanating from the control unit 8 are represented with dashed lines, and all the air lines are represented with solid lines.

In the embodiment of FIG. 1, the auxiliary jets 4 and the tensioning jets 3 are supplied with compressed air via supply lines 12 which are connected to the reservoir 5. Each supply line includes an adjustable pressure-reducing valve 9, a valve 10 which opens and closes synchronously with the insertion cycle and a check valve 19. In the illustrated embodiment, a cam shaft 11 controls the opening and closing of each of the valves 10.

The part of the air supply system described thus far in this description corresponds generally to the arrangement described, e.g., in U.S. Pat. No. 4,187,888 or 4,332,280. A critical feature of this known air supply system, in connection with the air jet weaving machine of FIG. 1, is that the air supply pressure for the tensioning jets 3 and the auxiliary jets 4 (while the weaving machine is operating) is always that established by the pressure-reducing valves 9. In particular, the pressure remains the same for the two different weft threads Wa, Wb.

In the embodiment of FIG. 1, there is an auxiliary supply line 13 associated with each main supply line 12 and running in parallel with the main supply line 12 from the reservoir 5 to a segment of the respective supply line 12 which segment lies between the pressure-reducing valve 9 and the valve 10. Each auxiliary supply line 13 includes an opening and closing valve 15 and a pressure-reducing valve 14. The opening and closing valves 15 are connected to the control unit 8 via control lines 20. The opening and closing valves 15 are controlled by the control unit 8 such that they are only opened during the insertion of the weft thread Wa or Wb which requires a higher air supply pressure.

In this connection, the pressure-reducing valves 14 are set at a higher pressure than the pressure-reducing valves 9. When the opening and closing valves 15 are closed by the control unit 8, compressed air flows from the reservoir 5 to the valves 10 via respective supply lines 12 through pressure-reducing valves 9. Accordingly, the weft thread Wb or Wa is transported and tensioned at the lower pressure established in pressure-reducing valve 9. In this way, when each weft thread Wa or Wb is inserted, the auxiliary jets 4 and the tensioning jets 3 are supplied with air at the specific air supply pressures prescribed for the respective type of weft thread.

In the embodiment of FIG. 2, for each type of weft thread Wa, Wb, a separate air supply line 16*a*, 16*b* respectively, runs between the reservoir 5 and each group of auxiliary jets 4. Another separate supply line runs between the reservoir 5 and the tensioning jets 3. Each air supply line 16*a*, 16*b* includes a pressure-reducing valve 17*a*, 17*b*, an opening and closing valve 18*a*, 18*b*, and a check valve 21*a* and 21*b*, respectively. The opening and closing valves 18*a*, 18*b* are connected to the control unit 8 such that they are opened only during the insertion of the corresponding weft thread Wa or Wb. If more than two different types of weft threads are used, a corresponding number of air supply lines connected in parallel is provided. In other words, if n types of thread are employed, then n supply lines 16*a*, 16*b*, . . . , 16*n* are provided.

The air supply system represented in FIGS. 1 and 2 is devised so that for each group of auxiliary jets 4 and for the tensioning jets 3, the air supply pressure is varied synchronously with the weft insertion sequence. If the need should arise the synchronous variation of the air supply pressure may be limited to the tensioning jets 3 or to the auxiliary jets 4, or to selected auxiliary jets 4 and/or the tensioning jets 3. Thus, for example, with the aim of refining the tensioning and holding taut of the inserted weft threads, the air supply pressure may be varied only for the auxiliary jets 4 disposed at the far end of the warp shed and for the tensioning jets 3. For this purpose, the reservoir 5 may be divided into different longitudinal segments for the groups of auxiliary jets 4, as generally described in U.S. Pat. No. 4,212,330.

All the pressure-reducing or throttle valves 9, 14 represented in FIG. 1, or such valves 17*a* and 17*b* represented in FIG. 2, may alternatively be in the form of pressure-regulating valves, whereby all the auxiliary jets 4 and tensioning jets 3 may receive air at either the same or different pressures by these valves alone. In this way, the need for extra parallel supply lines is eliminated.

It may happen in practice that one of the two different weft threads Wa, Wb does not need to be tensioned. In this case the elements 16*b*, 17*b*, 18*b*, and 21*b* in the air supply system of FIG. 2 may be dispensed with.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

What is claimed is:

1. A method of inserting different weft threads having different yarn properties into a warp shed of an air jet weaving machine according to a predetermined insertion sequence, comprising the steps of feeding different weft threads from corresponding spools to a first jet arrangement supplied with a flowing fluid, inserting the weft threads into the warp shed through said first jet arrangement and a second jet arrangement downstream of the first jet arrangement in the weft insertion direction, supplying said second jet arrangement with a flowing fluid, operating the second jet arrangement concurrently with the first jet arrangement, changing the fluid supply pressure for at least a portion of the second jet arrangement independently of the fluid supply pressure of the first jet arrangement for different types of weft thread synchronously with the insertion sequence for the different weft thread.

2. The method according to claim 1, wherein the second jet arrangement comprises auxiliary nozzles which are distributed along the width of the warp and are adapted to move into and out of the warp shed, and wherein the fluid supply pressure is changed synchronously with the weft insertion sequence at least for the auxiliary nozzles disposed at an end of the warp shed opposite from the first jet arrangement.

3. The method according to claim 1 or 2, further comprising tensioning the inserted weft thread with a tensioning jet provided in said second jet arrangement, said tensioning jet being disposed downstream of and outside an end of the warp shed opposite from the first jet arrangement in the weft insertion direction, wherein the fluid supply pressure to the tensioning jet is changed synchronously with the weft insertion sequence.

4. A jet weaving machine for inserting various types of weft threads having different yarn properties in a predetermined insertion sequence, said machine comprising a first jet arrangement disposed upstream of a warp shed in the weft insertion direction, a second jet arrangement arranged downstream of the first jet arrangement in the weft insertion direction and connected to a source of pressurized fluid via a supply line, said supply line including controlled valve means, a weft preparation device arranged upstream of the first jet arrangement in the weft insertion direction, control means for controlling the feed sequence of the different weft threads from the weft preparation device to the first jet arrangement, and controlled adjusting means for adjusting the fluid supply pressure for at least a portion of the second jet arrangement, whereby the fluid supply pressure at said portion of the second jet arrangement is adjustable to different values, the controlled adjusting means being connected to and controlled by the control means which control the feed sequence of the different weft threads, the fluid supply line for the second jet arrangement includes a first closing valve which is adapted to be operated synchronously with the weft insertion sequence, said fluid supply line further including a first pressure-reducing valve, the controlled adjusting means including at least one auxiliary supply line, said auxiliary line connecting the source of the pressurized fluid to a segment of the supply line lying between the first reducing valve and the first closing valve, said auxiliary line including a second closing valve and a second pressure-reducing valve, the second pressure-reducing valve being set at a higher pressure than the first closing valve, the second closing valve being opened by the control means which control the feed sequence of the different weft threads, said opening occurring only during the insertion phase of weft threads having yarn properties which require a higher fluid supply pressure.

5. The jet weaving machine according to claim 4, wherein n-1 auxiliary fluid supply lines are provided for n types of weft threads.

6. The jet weaving machine according to claim 4, wherein the second jet arrangement comprises auxiliary nozzles which are distributed along the width of the warp and are adapted to move into and out of the warp shed, the controlled adjusting means which include the auxiliary fluid supply line cooperating with at least the auxiliary nozzles arranged at an end of the warp shed opposite from the first jet arrangement.

7. The jet weaving machine according to claim 6, wherein all of the auxiliary nozzles cooperate with the controlled adjusting means which include the auxiliary fluid supply line.

8. The jet weaving machine according to claim 4, wherein said second jet arrangement includes a tensioning jet for tensioning the inserted weft thread, said tensioning jet being disposed beyond an end of the warp shed opposite from the first jet arrangement, the tensioning jet cooperating with the controlled adjusting means which include an auxiliary fluid supply line.

9. A jet weaving machine for inserting various types of weft threads having different yarn properties in a predetermined insertion sequence, said machine comprising a first jet arrangement disposed upstream of a warp shed in the weft insertion direction, a second jet arrangement arranged downstream of the first jet arrangement in the weft insertion direction and connected to a source of pressurized fluid via a supply line, said supply line including controlled valve means, a weft preparation device arranged upstream of the first jet arrangement in the weft insertion direction, control means for controlling the feed sequence of the different weft threads from the weft preparation device to the first jet arrangement, and controlled adjusting means for adjusting the fluid supply pressure for at least a portion of the second jet arrangement, whereby the fluid supply pressure at said portion of the second jet arrangement is adjustable to different values, the controlled adjusting means being connected to and controlled by the control means which control the feed sequence of the different weft threads, the fluid supply line for the second jet arrangement includes a first closing valve and a first pressure-reducing valve, at least one second supply line connecting the source of the pressurized fluid to the second jet arrangement, the second supply line including a second closing valve and a second pressure-reducing valve, and both of said closing valves being connected to the control means which control the feed sequence of the different weft threads and being selectively actuable corresponding to the different threads in the insertion sequence.

10. The jet weaving machine according to claim 9, wherein n-1 second fluid supply lines are provided for n types of weft threads.

11. The jet weaving machine according to claim 9, wherein the second jet arrangement comprises auxiliary nozzles which are distributed along the width of the warp and are adapted to move into and out of the warp shed, at least the auxiliary nozzles disposed at an end of the warp shed opposite from the first jet arrangement being connected to the main and a second fluid supply line.

12. The jet weaving machine according to claim 11, wherein all of the auxiliary jets are connected to the main and the second fluid supply line.

13. The jet weaving machine according to claim 9, wherein said second jet arrangement includes a tensioning jet for tensioning the inserted weft thread, said tensioning jet being disposed beyond an end of the warp shed opposite from the first jet arrangement, the tensioning jet being connected to the main and a second fluid supply line.

* * * * *